US011801190B2

(12) United States Patent
Budagher

(10) Patent No.: US 11,801,190 B2
(45) Date of Patent: Oct. 31, 2023

(54) THREE-AXIS ROTATION SYSTEM AND METHOD

(71) Applicant: OVARD, LLC, Dallas, TX (US)

(72) Inventor: Michael Budagher, Dallas, TX (US)

(73) Assignee: OVARD, LLC, Dallas, TX (US)

( * ) Notice: Subject to any disclaimer, the term of this patent is extended or adjusted under 35 U.S.C. 154(b) by 314 days.

(21) Appl. No.: 17/349,686

(22) Filed: Jun. 16, 2021

(65) Prior Publication Data

US 2021/0307993 A1 Oct. 7, 2021

Related U.S. Application Data

(63) Continuation of application No. 14/807,405, filed on Jul. 23, 2015, now Pat. No. 11,039,973.

(60) Provisional application No. 62/106,637, filed on Jan. 22, 2015.

(51) Int. Cl.
*A61H 1/00* (2006.01)
*A61G 15/02* (2006.01)

(52) U.S. Cl.
CPC ..... *A61H 1/001* (2013.01); *A61G 15/02* (2013.01); *A61H 2201/1215* (2013.01); *A61H 2201/1673* (2013.01)

(58) Field of Classification Search
CPC ..... A61H 1/001; A61H 1/003; A61H 1/005; A61H 2201/12; A61H 2201/1207; A61H 2201/1215; A61B 5/4863; A61B 5/4884
See application file for complete search history.

(56) References Cited

U.S. PATENT DOCUMENTS 3,141,669 A * 7/1964 Chul ..... A63B 19/04 472/17
3,286,707 A * 11/1966 Shafer ..... A61F 5/3769 5/624
3,936,047 A * 2/1976 Brandt ..... A63G 31/00 482/130
4,402,500 A * 9/1983 Coles ..... A63B 19/04 472/17
4,710,128 A * 12/1987 Wachsmuth ..... G09B 9/12 434/30
5,725,435 A * 3/1998 De Castro Faria .... A63G 31/00 472/59
5,792,031 A * 8/1998 Alton ..... G09B 19/0038 482/901
5,980,256 A * 11/1999 Carmein ..... G09B 9/165 482/902
6,017,276 A * 1/2000 Elson ..... A63G 31/16 472/60
6,800,062 B2 * 10/2004 Epley ..... A61B 5/7435 600/558
7,559,766 B2 * 7/2009 Epley ..... A61B 5/4863 434/34
2004/0006287 A1 * 1/2004 Epley ..... A61B 5/4884 600/595
2004/0138593 A1 * 7/2004 Maher ..... A63B 19/04 601/84

(Continued)

*Primary Examiner* — Michael J Tsai
(74) *Attorney, Agent, or Firm* — J. Miguel Hernandez; James R. Gourley; Carstens, Allen & Gourley, LLP

(57) ABSTRACT

A system and method are disclosed that allows a practitioner to rotate a human subject in three different axes of rotation, independently from one another and without limitation on the degree of rotation, which allows for the treatment of various systems of the human subject.

1 Claim, 9 Drawing Sheets

(56) References Cited

U.S. PATENT DOCUMENTS

| | | | | |
|---|---|---|---|---|
| 2007/0167886 | A1* | 7/2007 | Epley | A61B 5/4863 601/86 |
| 2008/0272265 | A1* | 11/2008 | Ciesielka | A47C 15/004 248/370 |
| 2011/0028872 | A1* | 2/2011 | Kevin | G07F 17/3216 601/86 |
| 2011/0054356 | A1* | 3/2011 | Merfeld | A61B 5/4884 600/587 |
| 2012/0006334 | A1* | 1/2012 | Cayabyab | A61H 1/001 600/38 |
| 2014/0087340 | A1* | 3/2014 | Maher | G09B 19/00 434/247 |
| 2015/0011920 | A1* | 1/2015 | Purcell | A61H 1/001 601/112 |
| 2016/0106614 | A1* | 4/2016 | Kim | A61H 1/001 297/326 |
| 2018/0332969 | A1* | 11/2018 | Terzini | A47C 3/0257 |

* cited by examiner

THREE-AXIS ROTATION SYSTEM AND METHOD

CROSS-REFERENCE TO RELATED APPLICATION

This application is a continuation application of co-pending U.S. application Ser. No. 14/807,405 filed on Jul. 23, 2015 and entitled "Three-Axis Rotation System and Method," which application claims priority to and the benefit of U.S. Provisional Patent Application Ser. No. 62/106,637 filed on Jan. 22, 2015, and entitled "OFF-VERTICAL AXIS ROTATIONAL DEVICE PATIENT ROBOT—MEDICAL DEVICE CONCEPT," the technical disclosures of which are hereby incorporated by reference in their entirety.

BACKGROUND OF THE INVENTION

Technical Field

The present invention relates to a three-axis rotation system and method, and more particularly a system and method that allows a practitioner to position or rotate a human body along three axes, independently from one another, in order to diagnose or treat at least one system of the human body.

Description of Related Art

Many patients with brain injuries, neurodevelopmental disorders, or neurodegenerative disorders have impaired motor and cognitive capabilities. It is well evidenced that basic and complex motor and cognitive functions have direct and indirect dependencies on head, neck, and ocular movements. The vestibular and ocular organs are primary sensors, which help our brain understand our spatial orientation and how to interact in our environment. The ability to measure head, neck, and eye movements and quantify deficiencies enables an opportunity to therapeutically rehabilitate these organs and improve human performance.

Systems for rotating a human body for the purpose of diagnosing and treating the human vestibular system are known in the art. U.S. Pat. Nos. 6,800,062, 7,559,766 and 8,702,631 all describe such systems. However, none of those systems are capable of rotating the human body in three different axes, which are perpendicular to one another and allow for rotation or positioning about each the three different axes independently of one another, and without limitation on the degree of rotation or position. As described below in the detailed written description, the system of the present invention implements several different features and technologies that differentiate it from the prior art.

SUMMARY OF THE INVENTION

In one embodiment, a system for rotation of a human body in three-dimensional space comprises: a yaw frame contained within a roll frame, wherein the yaw frame is driven by a yaw motor to rotate about a yaw axis within the roll frame, and wherein the roll frame is driven by a roll motor to rotate about a roll axis; a pitch frame contained within the yaw frame, wherein the pitch frame is driven by a pitch motor to rotate about a pitch axis within the yaw frame; a seat affixed within the pitch frame; wherein the roll frame, the yaw frame and the pitch frame define a rotational space, and wherein the roll motor, the yaw motor and the pitch motor are located outside the rotational space.

In another embodiment according to any other embodiment or combination of embodiments disclosed herein, a system further comprises: a support frame comprising the roll drive motor coupled to a roll drive wheel, wherein the roll drive wheel is in contact with the roll frame, wherein rotation of the roll drive wheel causes rotation of the roll frame about a roll axis; a yaw drive system comprising the yaw drive motor coupled to a yaw drive belt, wherein the yaw drive belt is coupled to a yaw drive shaft, wherein the yaw drive shaft is coupled to a yaw drive actuator, wherein the yaw drive actuator is coupled to the yaw frame; a pitch drive system comprising the pitch drive motor coupled to a first pitch drive belt, wherein the first pitch drive belt is coupled to a first pitch drive shaft; wherein the first pitch drive shaft is coupled to a second pitch drive shaft; wherein the second pitch drive shaft is coupled to a pitch drive actuator, wherein the pitch drive actuator is coupled to the pitch frame.

In another embodiment according to any other embodiment or combination of embodiments disclosed herein, a system further comprises an annular truss, a plurality of axial trusses extending from the annular truss, and a plurality of radial trusses that meet at an internal drive hub. In another embodiment according to any other embodiment or combination of embodiments disclosed herein, a system further comprises the feature wherein the roll frame comprises a circumferential drive belt that engages with the roll drive wheel.

In one embodiment, a method for stimulating a vestibular system in a human subject comprises: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and stimulating at least one of an inner ear canal, a utricle or a saccule in the human subject by rotating the human subject independently around the pitch, roll and yaw axes.

In one embodiment, a method for stimulating a visual system in a human subject comprises: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and rotating the human subject independently around the pitch, roll and yaw axes while the human subject is fixating on a visual target.

In one embodiment, a method for stimulating a proprioceptive system in a human subject comprises: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and stimulating the proprioceptive system in the human subject by rotating the human subject independently around the pitch, roll and yaw axes.

In one embodiment, a method for stimulating a vascular system in a human subject's brain comprises: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and perfusing blood into a region of the brain by rotating the human subject independently around the pitch, roll and yaw axes.

In another embodiment according to any other embodiment or combination of embodiments disclosed herein, the method of further comprises the step of: stimulating a visual system in the human subject during the rotating step. In another embodiment according to any other embodiment or combination of embodiments disclosed herein, the method of further comprises the step of: perfusing blood into a region of the human subject's brain during the rotating step. In another embodiment according to any other embodiment or combination of embodiments disclosed herein, the method of further comprises the step of: stimulating a proprioceptive system in the human subject during the rotating step. In another embodiment according to any other embodiment or combination of embodiments disclosed herein, the method of further comprises the step of: stimulating at least one of an inner ear canal, a utricle or a saccule in the human subject during the rotating step. In another embodiment according to any other embodiment or combination of embodiments disclosed herein, the method of further comprises at least one of the steps disclosed above, or any combination of the steps disclosed above.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
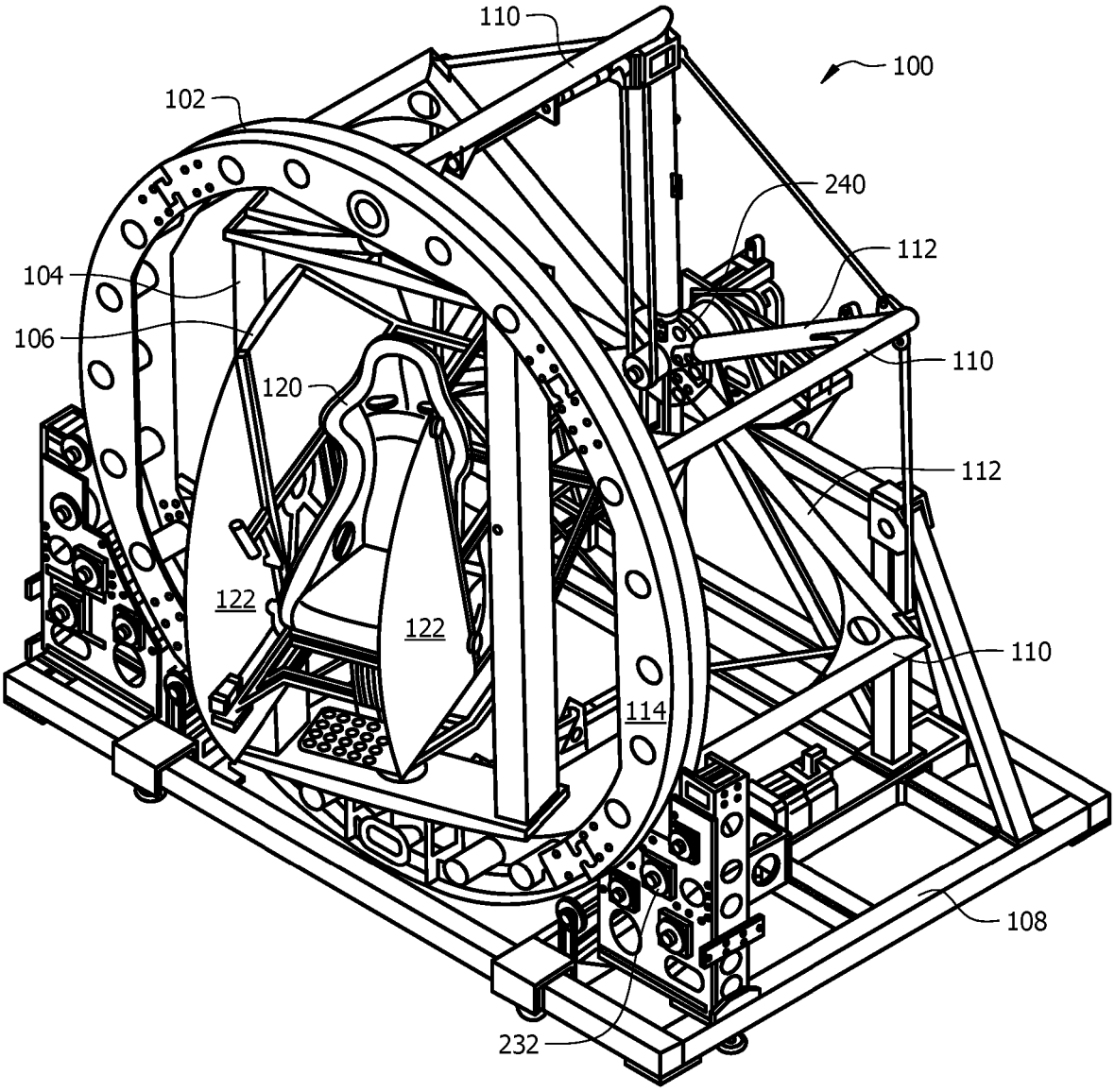
FIG. 1 illustrates a front perspective view of one embodiment of the three-axis rotation device of the present invention.

FIG. 1 depicts a perspective view of one embodiment of the three-axis human rotation system 100 of the present invention. Generally, the system comprises a roll frame 102, a yaw frame 104 and a pitch frame 106. The pitch frame 106 is contained within the yaw frame 104, and the yaw frame 104 is contained within the roll frame 102. The language "contained within" is intended to mean, for example, that when the yaw frame is rotated around the yaw axis, the pitch frame will also be rotated around the yaw axis. Of course, the pitch frame can also be rotated around the pitch axis at the same time as it is being rotated around the yaw axis by the yaw frame, or at a different time.

Additionally, the yaw frame being "contained within" the roll frame means that when the roll frame is rotated around the roll axis, the yaw frame will also be rotated about the roll axis. It should also be understood that because the pitch frame is contained within the yaw frame, the pitch frame will also be rotated around the roll axis along with the yaw and roll frames.

Figure 4:
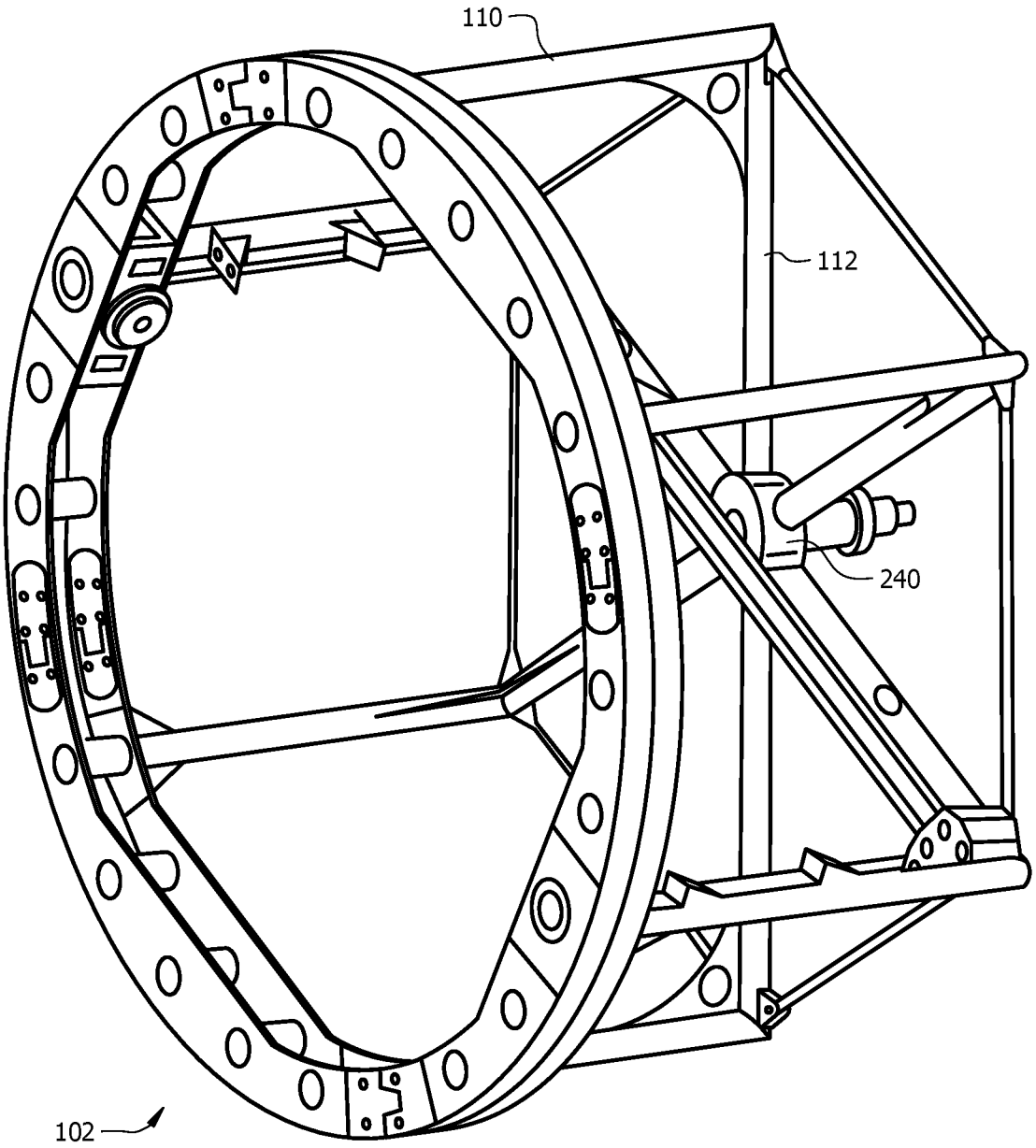
FIG. 4 illustrates a front perspective view of one embodiment of a roll frame of the three-axis rotation device of the present invention.

Each of the roll, yaw and pitch frames depicted in FIG. 1 are capable of being rotated about different axes completely independently from one another, and without any limitation on the degree of rotation. One embodiment of a roll frame is depicted in isolation in FIG. 4. As depicted in FIGS. 1 and 4, the roll frame 102 comprises a generally annular truss 114 with axial support trusses 110 extending therefrom. The axial trusses are generally parallel to the roll axis of rotation, which the roll frame rotates around. A radial truss 112 extends from the side of each axial truss 110 opposite the side that is attached to the annular truss 114. The radial trusses extend radially from the roll axis of rotation. The radial trusses 112 connect at internal drive hub 240. The internal drive hub 240 is the location at which the drive mechanisms (described in more detail below) used to actuate the yaw and pitch frames pass through the roll frame.

The roll frame is supported on base 108. Base 108 comprises a support frame that has mounted on it at least one roll drive motor 230, which is connected to drive wheel 232, and the drive wheel 232 is in contact with the annular truss 114 of the roll frame 102. Roll drive motor 230 rotates the drive wheel 232 in either direction. Rotation of the drive wheel 232 causes the entire roll frame 102 to rotate about the roll axis, which generally runs perpendicular to the plane defined by the front face of annular truss 114, and runs through the middle of internal drive hub 240.

Figure 5:
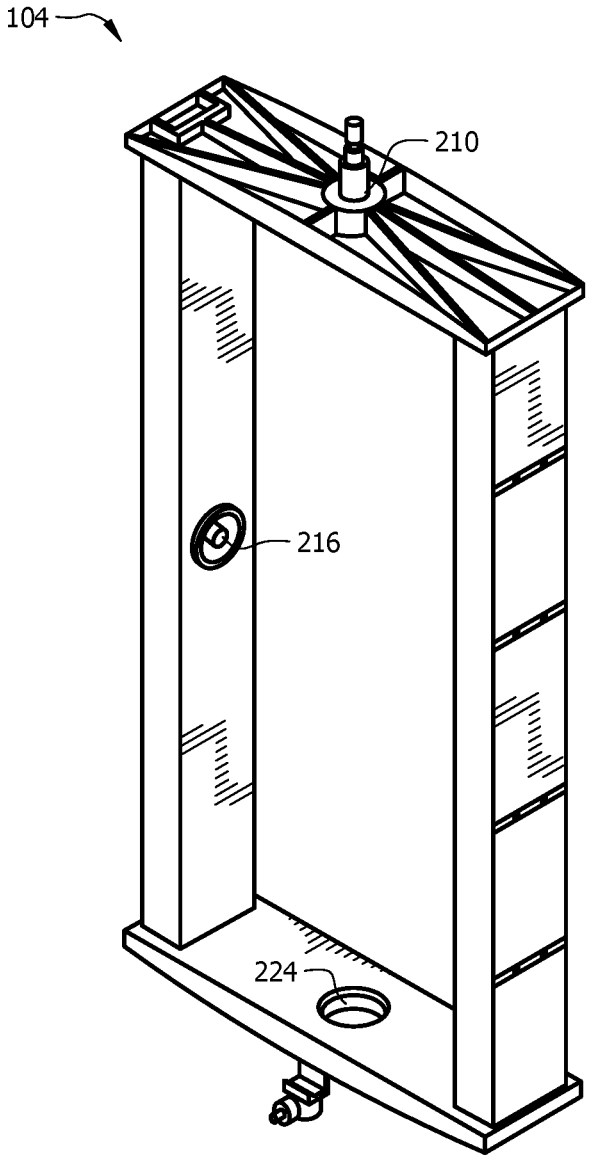
FIG. 5 illustrates a front perspective view of one embodiment of a yaw frame of the three-axis rotation device of the present invention.

FIG. 5 depicts one embodiment of a yaw frame 104 in isolation from the system. The yaw frame 104 is shown with a pitch frame torque transfer point 210, and pitch frame drive actuator assembly 216, which is coupled to the yaw frame. The yaw frame 104 houses at least a portion of the drive system (described in more detail below) that is used to drive the pitch frame 106 around the pitch axis. The yaw frame is rotated in the yaw direction by a yaw frame actuator (described in more detail below in conjunction with the drive system overall) that engages and is coupled to the yaw frame at location 224. The yaw axis of rotation runs through rotation points 210 and 224 depicted in FIG. 5.

Figure 2:
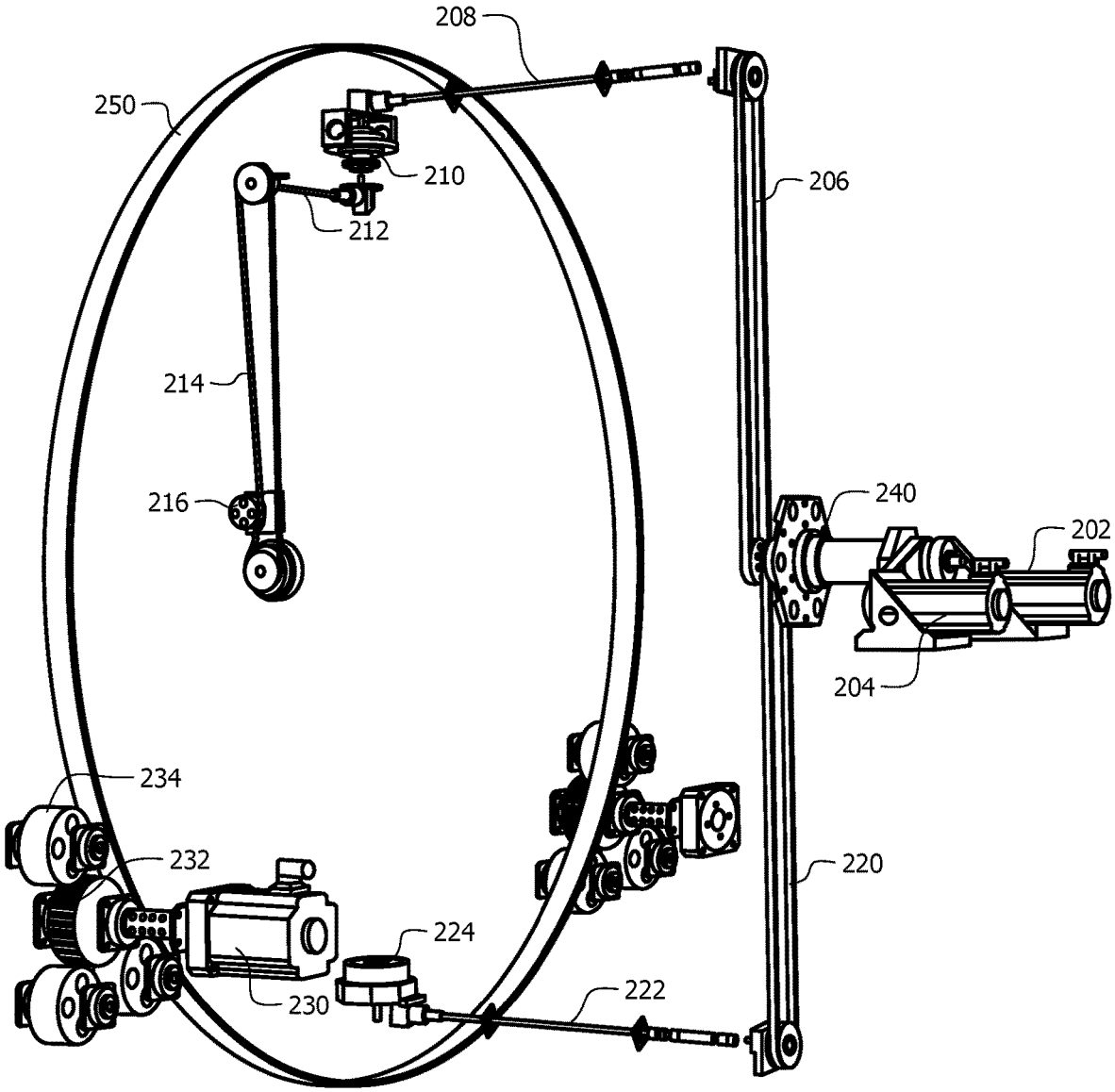
FIG. 2 illustrates a back perspective view of one embodiment of a drive system used for the three-axis rotation device of the present invention.

FIG. 2 depicts a back perspective view of one embodiment of a drive system in isolation from the overall three-axis rotation system. This embodiment of the drive system comprises a roll drive motor 230 coupled to roll drive wheel 232. Roll drive motor 230 is capable of turning roll drive wheel 232 in both directions of rotation (clockwise and counterclockwise). The roll frame may also be supported by one or more passive support wheels 234, which enable smooth operation of the system. To further ensure smooth rotation of the roll frame 102, the roll frame 102 may be encompassed by one or more circumferential belts 250 that engage the roll drive wheel 232. Such a circumferential drive belt around the roll frame may help compensate for any discontinuities in the roll frame circumference introduced during the roll frame manufacturing process, improve smooth movements for accelerations and decelerations, and improve the precision. In another embodiment, more than one roll drive motor and roll drive wheel are included in the system.

FIG. 2 also depicts components that drive the yaw and pitch rotational directions. Yaw drive motor 204 drives an internal drive shaft that runs through internal drive hub 240, and rotates yaw drive belt 220. The yaw drive belt 220 is coupled to yaw drive shaft 222, such that rotating yaw drive belt 220 in either direction of rotation causes yaw drive shaft 222 to rotate in the same direction. Similarly, yaw drive shaft 222 is coupled to the yaw frame actuator at location 224. The yaw frame actuator translates the torque applied to the yaw drive shaft 222 approximately 90° through the use of various internal gears, as is known in the art, and applies that torque to the yaw frame. When all of the components of the yaw drive system are considered in their entirety, the yaw drive motor is capable of rotating the yaw frame in both directions of rotation around the yaw axis.

Figure 3:
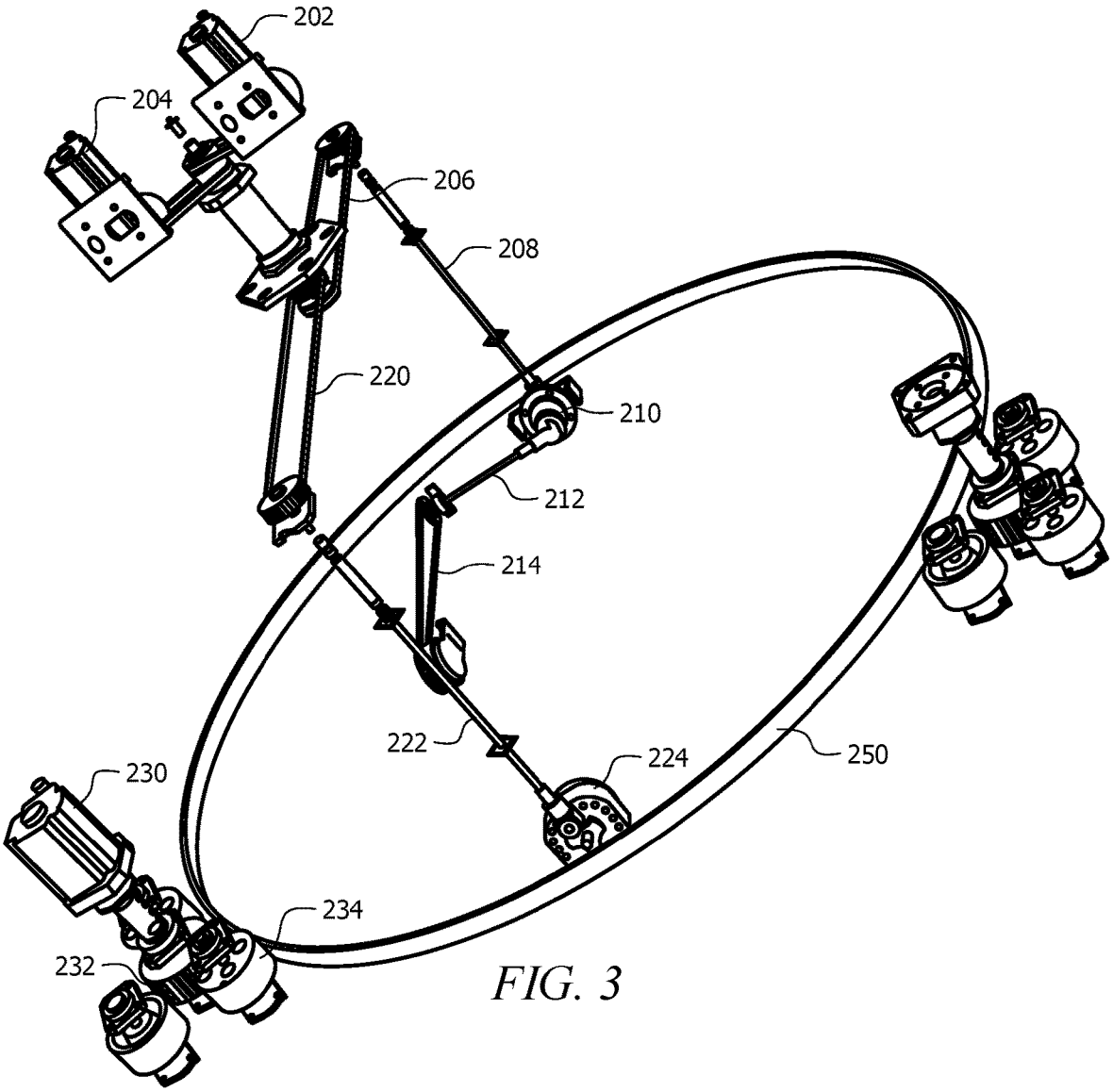
FIG. 3 illustrates a bottom perspective view of one embodiment of a drive system used for the three-axis rotation device of the present invention.

Also as depicted in FIG. 2, the pitch drive motor 202 drives an internal drive shaft that runs through internal drive hub 240, which is coaxial with the internal drive shaft that drives the yaw drive belt. However, the pitch drive motor 202 is coupled with the first pitch drive belt 206, such that rotation of the pitch drive motor 202 causes rotation of the first pitch drive belt 206 in the same direction. First pitch drive belt 206 is coupled to a first pitch drive shaft 208, such that rotation of the first pitch drive belt 206 causes rotation of the first pitch drive shaft 208 in the same direction. The torque applied to the first pitch drive shaft 208 by first pitch drive belt 206 is translated approximately 90° through the use of various internal gears at 210, as is known in the art, to drive a second pitch drive shaft 212. As such, the first pitch drive shaft 208 is coupled with the second pitch drive shaft 212, such that rotation of the first pitch drive shaft causes rotation of second pitch drive shaft. Second pitch drive shaft 212 is coupled to second pitch drive belt 214. Finally, pitch frame actuator 216 is coupled to second pitch drive belt 214, such that rotation of the second pitch drive belt 214 in either direction will correspondingly cause rotation of the pitch frame actuator 216 about the pitch axis. FIG. 3 depicts a different perspective view of the drive system of FIG. 2.

One inventive aspect of the system of the present invention lies in the arrangement of the drive system. The drive system uniquely allows for rotation of a human subject seated in a seat attached to the pitch frame around three perpendicular axes of rotation completely independently of one another. Taking FIGS. 1 and 2 in combination, it is seen that the roll axis of rotation does not vary its orientation with respect to gravity regardless of the extent to which the roll frame is rotated about the roll axis, and regardless of whether the yaw or pitch drive systems are used. However, the use of drive belts 206 and 220, which are mechanically coupled to the various drive shafts and frame actuators of the yaw and pitch drive systems, allows for the roll frame to be rotated about the roll axis at any orientation, and still enable the yaw and pitch drive systems to operate. Similarly, the pitch drive system allows for the yaw frame to be rotated at any orientation with respect to the roll frame, and still enable the pitch drive system to rotate the pitch frame about the pitch axis. Such a drive system is unknown in the art and represents a marked improvement over prior art systems.

Some of the drive system components can be hidden within the various frames used in the overall system. For example, the second pitch drive shaft 212 and second pitch drive belt 214 can be hidden within the yaw frame 104 (depicted in FIG. 5). Also, the yaw drive shaft 222 could be hidden within the roll frame 102, for example, within one of the axial trusses 110.

The roll, yaw and pitch drive motors are controlled by a computer system operatively coupled to the drive motors. The position, angle of rotation, and speed of the various rotation frames are detected using one or a combination of sensors configured for that purpose. Preferably, sensors that detect the position, angle and speed of rotation for each rotation frame are embedded within, integral to, or in close proximity to the actuator for the frame. The computer system, or control module of the computer system, uses the positional information in a feedback, feed forward, or combination thereof scheme to execute the positional and rotational maneuvers and treatment methods described herein, or as desired by a practitioner of the present invention.

Figure 6:
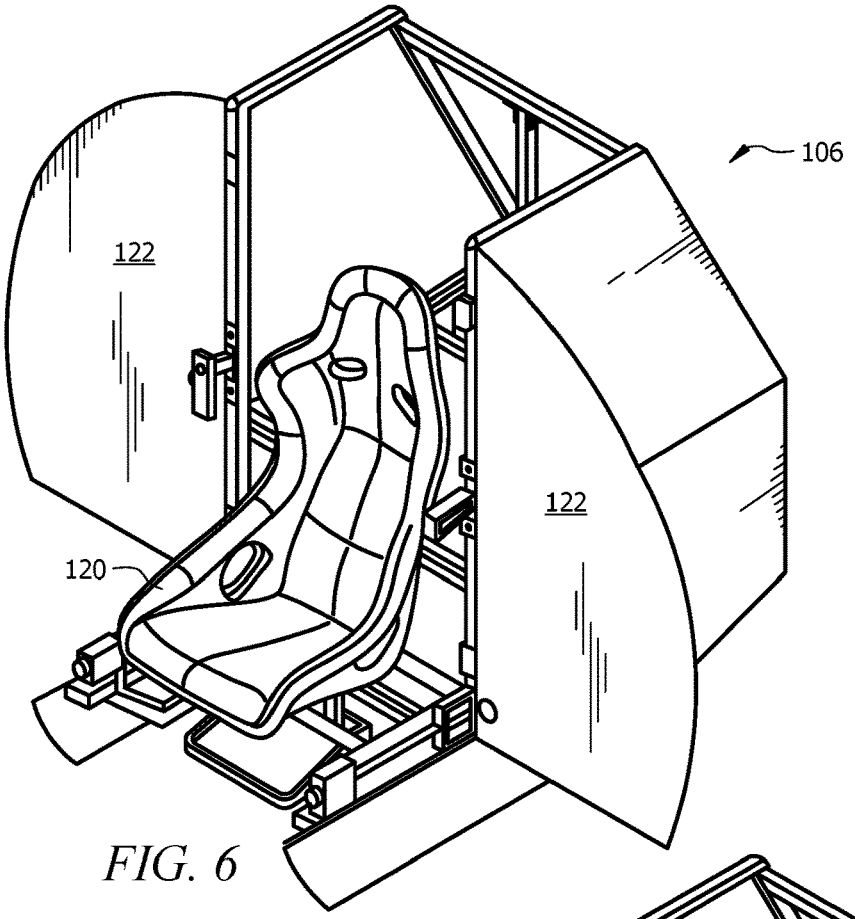
FIG. 6 illustrates a perspective view of one embodiment of the seat compartment of the three-axis rotation device of the present invention, with the flaps open and seat extended.
Figure 7:
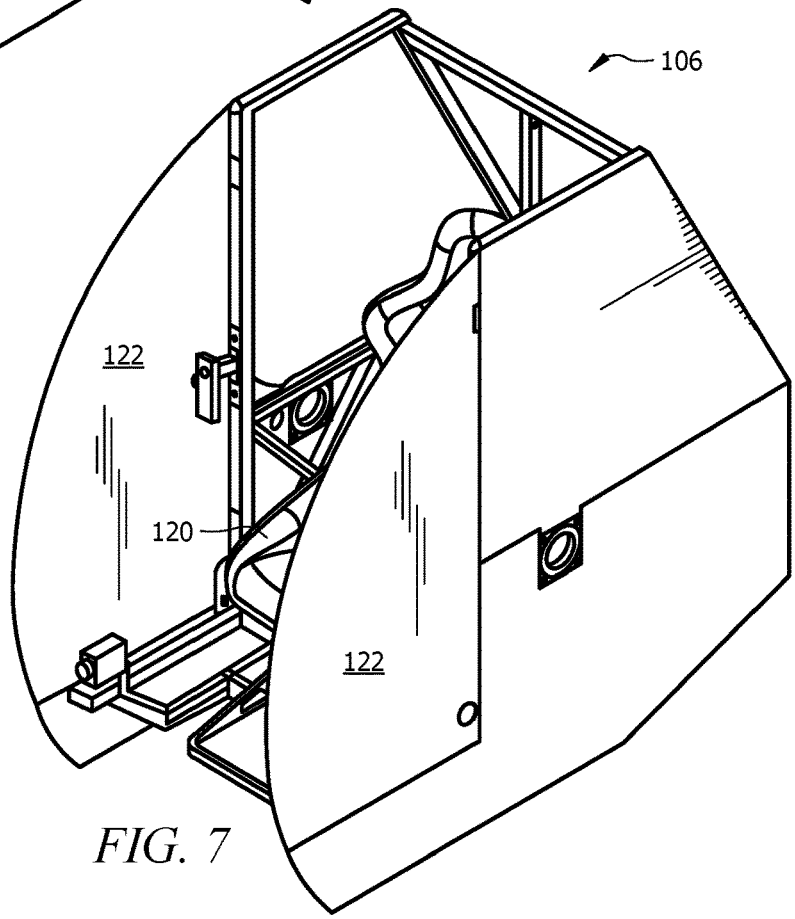
FIG. 7 illustrates a perspective view of one embodiment of the seat compartment of the three-axis rotation device of the present invention, with the flaps closed and seat retracted.

FIGS. 6 and 7 depict perspective views of one embodiment of the pitch frame. The pitch frame comprises a seat 120 configured for a human body affixed to the pitch frame. Generally, the seat will comprise a restraint mechanism, such as straps, belts or harnesses, which have been omitted from the figures for clarity. In one embodiment, the pitch frame comprises protective flaps 122. Protective flaps 122 are located on opposite sides of the seat 120, and can be connected to the pitch frame by a hinged connection, such that they are able to rotate between an open position (FIG. 6) and a closed position (FIG. 7). When the protective flaps 122 are in a closed position, a human subject sitting in seat 120 is prevented from reaching extremities (arms, legs, hands, etc.) outside the pitch frame, thereby preventing injury to the human subject during operation of the system. Also, in another embodiment, the seat 120 can shift between an extended position (FIG. 6) and a retracted position (FIG. 7). This feature allows for an easier ingress and egress for the human subject undergoing evaluation or treatment within the system.

Figure 8:
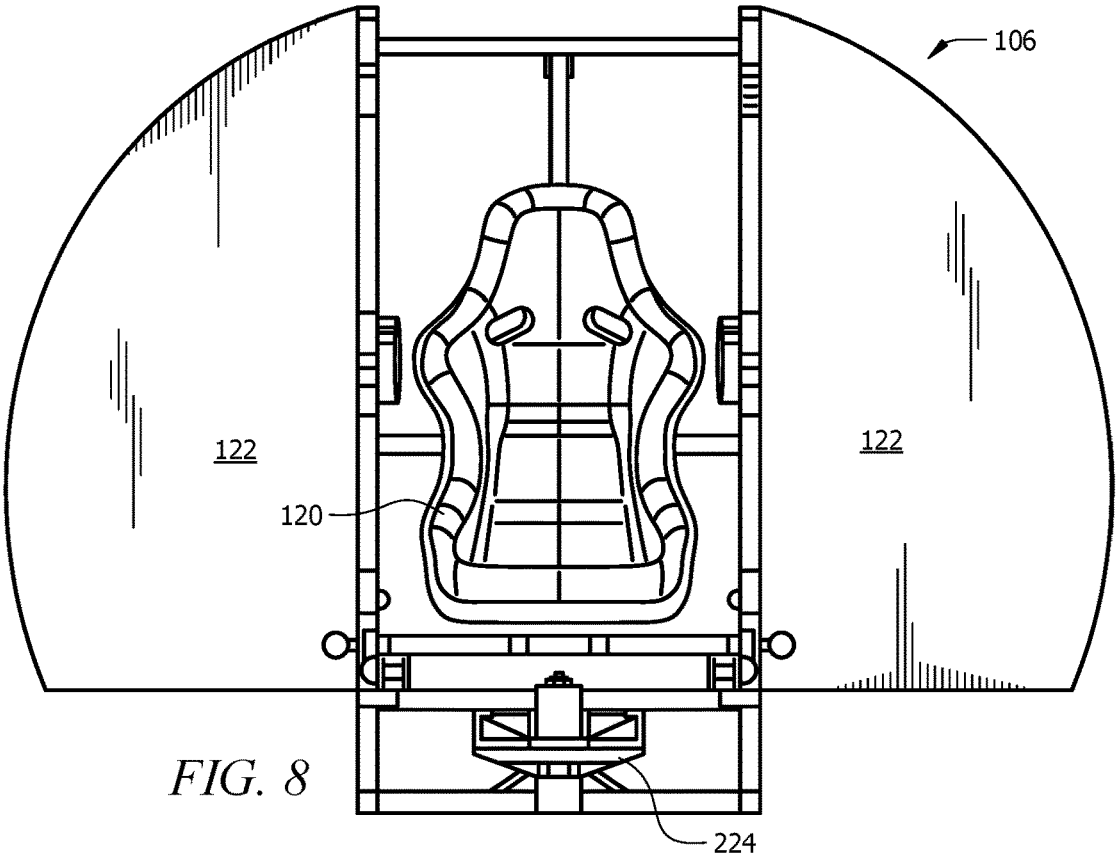
FIG. 8 illustrates a frontal view of one embodiment of the seat compartment of the three-axis rotation device of the present invention, with the flaps open.
Figure 9:
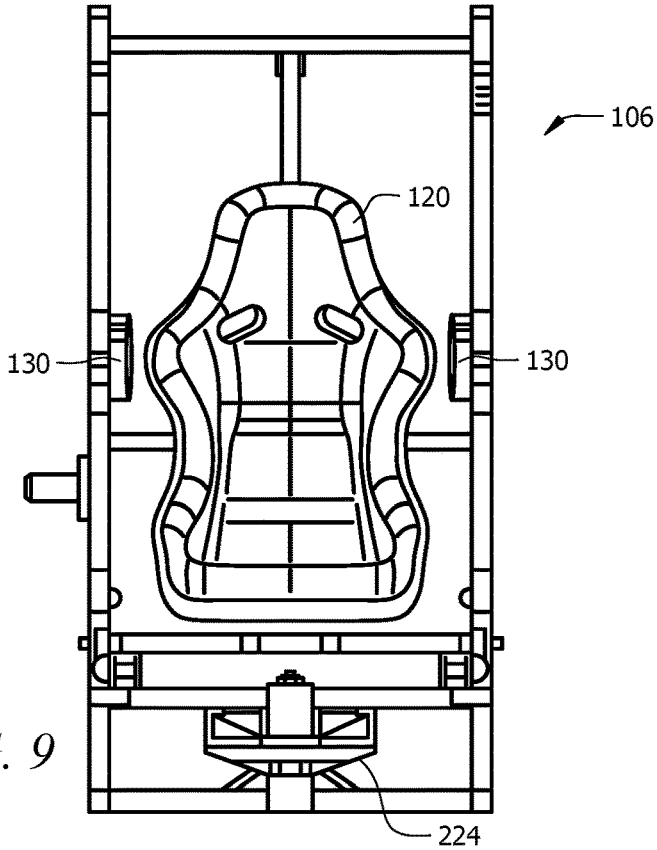
FIG. 9 illustrates a frontal view of one embodiment of the seat compartment of the three-axis rotation device of the present invention, with the flaps closed.

FIGS. 8 and 9 are frontal views of the embodiment of the pitch frame 106 and seat assembly shown in FIGS. 6 and 7. The pitch axis of rotation runs through rotation points 130. The pitch drive actuator can be coupled to the pitch frame at either of these rotation points 130, with the other rotation point being passively rotationally coupled to the yaw frame on the opposite side.

Figure 10:
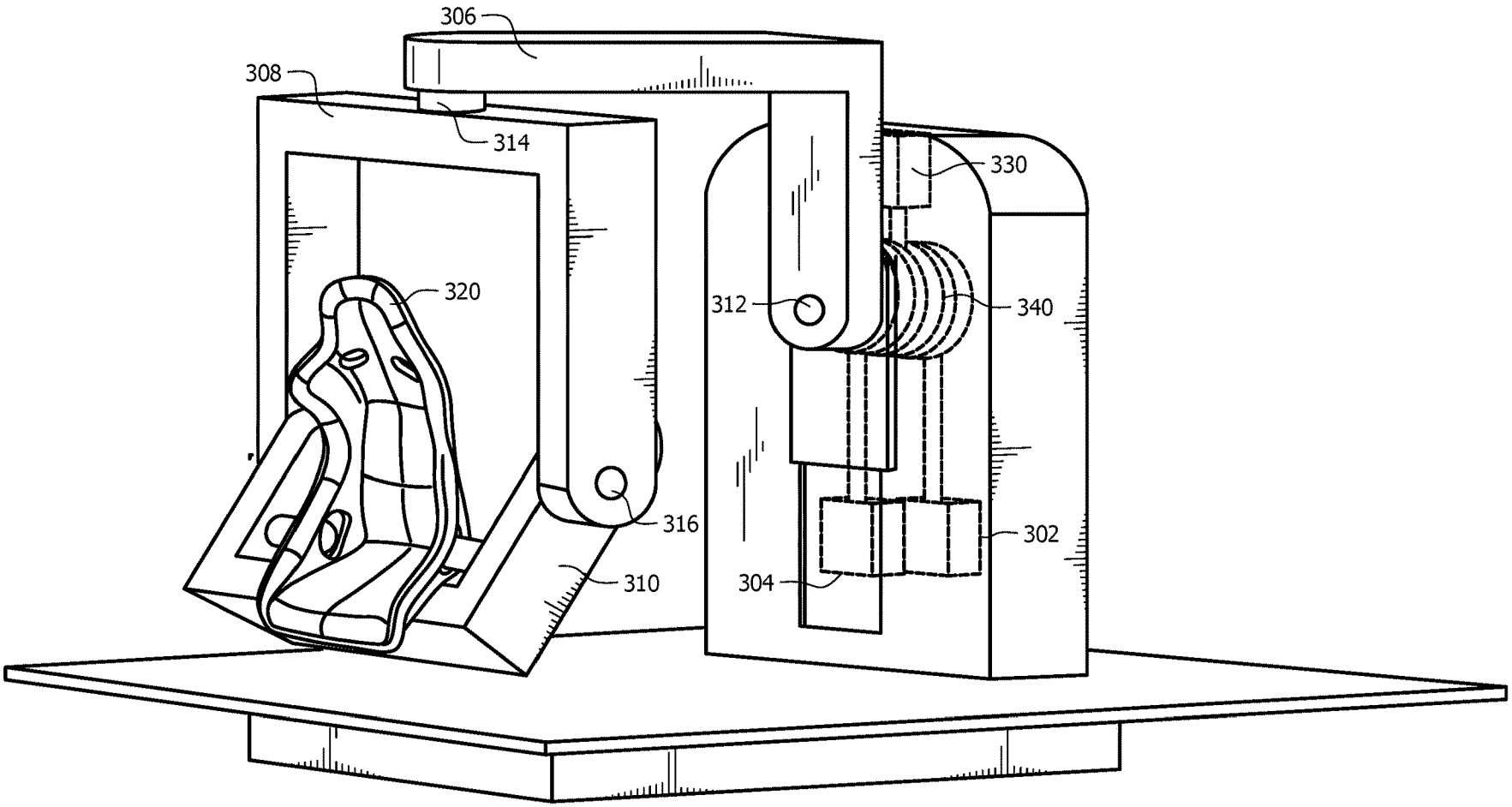
FIG. 10 depicts a perspective view of another embodiment of the three-axis rotation device of the present invention.
Figure 11:
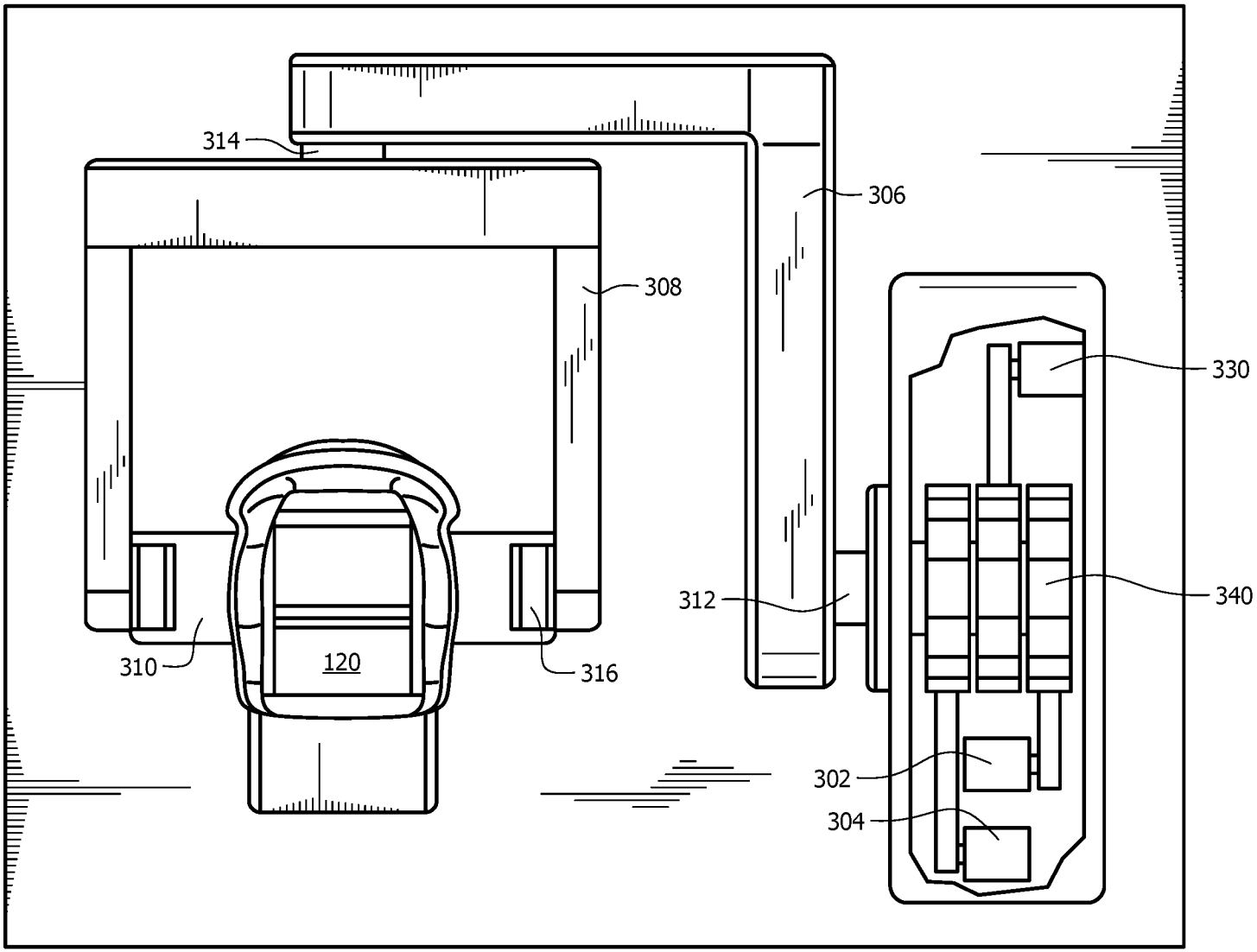
FIG. 11 depicts a top plan view of another embodiment of the three-axis rotation device of the present invention.

FIG. 10 depicts a perspective view of another embodiment of the three-axis rotation system of the present invention. As depicted therein, the roll frame 306 comprises an L-shaped truss, which is rotated around the roll axis at 312 by a roll drive motor 330. Contained within the roll frame 306 is a C-shaped yaw frame 308, and contained within the yaw frame 308 is a C-shaped pitch frame 310. The yaw frame 308 is rotated around the yaw axis at 314 by a yaw drive motor 302. The seat or chair 320 is affixed to/contained within the pitch frame 310, and rotates about the pitch axis at 316 when the pitch frame 310 is actuated by the pitch drive motor 304. The drive motors are coupled to their respective frames through one or a combination of drive belts and drive shafts, as described for the embodiment discussed above. The drive belts and shafts are depicted hidden within the respective roll, yaw and pitch frames, as described above. Also the placement of the drive motors shown in FIG. 10 is exemplary and not by way of limitation. FIG. 11 depicts a top plan view of another embodiment of the L-C-C frame assembly described above.

In a preferred embodiment, the roll frame can be raised and lowered to allow for easy access to the human subject being evaluated or treated. The L-shape of the roll frame is ideally suited for this purpose because the arm of the roll frame that connects to the yaw frame can be positioned above the chair, thereby providing unobstructed access to the ground from the chair.

The presently disclosed and claimed system allows a practitioner to rotate a human subject seated and restrained in the chair around three different axes independently from one another and without any restriction on the number of degrees of rotation. Because each axis of rotation can be programmed independently, an infinite number of position orientations or acceleration vectors can be applied to the human undergoing treatment. Prior art systems are not able to accomplish this.

This capability will enable the practitioner to use the system for at least the following purposes: proprioceptive therapy, vestibular therapy; visual/ocular therapy; vestibular-ocular reflex therapy; neuroplasticity/brain rewiring therapy; use of centrifugal force to drive blood flow/perfusion into specific parts of the brain as a therapy.

After assessing and quantifying a subject's brain function through a diagnostic process, specific rotational profiles can be created to stimulate, rehabilitate, and optimize brain function. By controlling the direction of rotation (+/−pitch, +/−roll, +/−yaw), acceleration, velocity, time duration, deceleration, static position of a single axis or two axes while the other(s) are rotating, and the combination of multiple axes of rotation into a single profile, a practitioner can target proprioceptive, vestibular, visual/ocular, vestibular-ocular reflex, blood flow injection by means of centrifugal force (induced perfusion), each as different therapeutic strategies or combinations of strategies.

In controlling the human subject's body (and head) rotation in sequenced and controlled movements, healthy neural pathways can be forged and reinforced while causing the atrophy of dysfunctional neural pathways. Sensory integration can be recalibrated to enable subjects to respond more accurately to their environment. By collecting physiological data, the system described and claimed herein is able to algorithmically respond with methods to accelerate the effectiveness of the therapy. Sequences of rotational movements can be combined to create complex therapy schemas. Visual image target(s) on a screen inside the patient cabin (pitch frame) can be passive or actively moving in any conceivable fashion to coordinate the rotational therapy with the planned sequences of eye movements relative to a fixed head.

Conditions applicable to therapy include, without limitation: performance enhancement; brain injury; traumatic brain injury; stroke; concussion; dementia; alzheimer's; brain fogginess; dizziness; vertigo; postural orthostatic tachycardia syndrome; cerebral palsy; down syndrome; autism; balance/fall risk; spatial/depth vision issues; dystonia; parkinson's; post-traumatic stress disorder; central nervous system disorders; immune system function as modulated by the brain; digestive system function as modulated by the brain; otolithic stimulation therapy; otolithic-ocular reflex therapy.

The mechanical design of the present invention also employs a unique drive train system that differentiates it from the prior art. In particular, all of the drive motors are located outside the rotational space of the apparatus. The rotational space is defined herein as the entire volume of space that could be occupied by the roll, pitch and yaw frames at all orientations. Known rotational systems use drive motors for each rotational axis that are mounted in-line with the gear that drives the axis. For example, a hypothetical prior art device that utilized the yaw frame shown in FIG. 5 would mount a motor in close proximity to location 224 to rotate the yaw frame about the yaw axis. This hypothetical motor for such a prior art device would thus be located within the rotational space of the apparatus. In order to provide the large amount of power needed by this motor contained within the rotational space, a slip ring would be required at the roll axis drive hub, and likely at the yaw axis drive hub, because the joints must allow for infinite rotation.

The problem with using slip rings to transmit high voltage or current electricity is that it introduces unwanted electromagnetic interference (EMI) into the electrical system. Minimization of EMI allows for maximum safety and efficiency of the system. Known multi-axis systems that use slip rings to power motors location within the rotational space have been observed to spontaneously move in directions that were not programmed. These uncontrolled movements are potentially very dangerous to the person undergoing treatment.

The present invention addresses this problem by using a combination of belts and shafts to transmit mechanical power from outside the rotational space through the various frames, eliminating the main source of EMI in known systems. This design provides a novel approach to administering continuous, independent three-axis rotation at a level of safety and reliability not achieved by known designs.

The 3-axis rotational device of the present invention has a number of qualities that make its clinical applications unique. Previous devices have not allowed for simultaneous, continuous three-axis rotation and positioning of a human subject. This attribute of the rotational chair allows for therapeutic customization that has not been achievable in prior art designs. Therapeutic interventions can be driven through the vestibular system, through the visual system, through activation of the proprioceptive system, and by increasing blood perfusion to central nervous system structures. Neural plasticity is the concept that the nervous system adapts and makes changes, either positively or negatively, based on changing demands of the environment. These changes and adaptations can be the result of typical interactions during day-to-day life, as a consequence of trauma or other neurodegenerative event, or through the application of rehabilitation strategies.

In order for neurons to function optimally in the nervous system, three conditions must be met. Neurons must have oxygen, nutrition, and activation in order to maintain their connections to other neurons. Neurons must have an increase in these three factors in order to create new connections between neurons or repair damaged connections. Oxygen and nutrition are delivered to the neurons through the vascular system and their delivery is driven by the needs of the neuronal cell. A neuron uses axons and dendrites to create synapses with multiple other neurons at varying levels of proximity creating a network of communication fibers that allow cells to communicate locally and also with distal areas of the body. Due to this relationship a neuron can be stimulated by multiple connected neurons as they are activated throughout the body. These connected neurons may be linked to a peripheral receptor or another part of the central nervous system. As a neuron's activation is increased, it will make additional connections to other neurons in its network. If a neuron experiences a decrease in activation, it will begin to lose and breakdown connections to other neuronal networks.

The vestibular system of a human subject gives the individual a sense of their position in space and helps orient them to their environment. This system is situated in the inner ear bilaterally and is composed of two different sensory organs. The first is the semicircular canal system, which is composed of six semicircular canals. The canals are oriented with three canals on each side of the head with an orthogonal orientation to each other. Each semicircular canal is paired with a canal of opposite orientation on the other side. The two horizontal canals are oriented to sense rotations around the Z axis (vertical axis), the two anterior canals are oriented at 45 degrees to the anterior sagittal and coronal body planes and detect rotations in the vertical planes of motion, and the two posterior canals are oriented at 45 degree angles to the posterior sagittal and coronal body planes and also detect angular motion in the vertical plane. The semicircular canals are filled with fluid and angular motion is detected as this fluid puts pressure on a sensory structure called the cupula. The cupula can emit an excitatory signal or an inhibitory signal that is sent to the brain depending on the direction it is pushed. If a subject is rotated to the right, the cupula in the right horizontal canal sends an excitatory signal to the brain and the cupula in the left horizontal canal sends an inhibitory signal. This is the mechanism by which all the semicircular canal pairings function.

The second sensory organ in the vestibular system is the otolithic organ. The otolithic system is located in the inner ear bilaterally and is connected with the semicircular canal system. The otolithic organ is composed of the utricle and the saccule and senses linear translation. The organ is composed of hair cells called stereocilia in a gelatinous membrane that is weighted by calcium carbonate crystals called otoliths. When the head is placed in various positions relative to gravity or a translational stimulation is administered, the otoliths create a shearing force on the stereocilia and generate either an excitatory or inhibitory signal, which propagates through central nervous system pathways. The utricle senses linear accelerations and head-tilt in the horizontal plane while the saccule detects linear accelerations and head tilt in the vertical plane. These signals are sent from the sensing structures of the vestibular system and integrate in multiple regions of the brain and brain stem for secondary processing.

The visual system is utilized to observe the environment and generate information that assists with balance, focus, and tracking. The visual system typically utilizes binocular vision with conjugate or coordinated eye movements to keep an object of interest in focus. Each eye has a retina, which contains light sensing cells that send signals to the brain to be interpreted as visual information. Within the retinal tissue is a structure called the fovea that is composed of light sensing cells responsible for color vision. In order to maintain clear vision, the visual system must be able to keep objects of interest focused on the fovea and perform proper and coordinated movements of the eyes to keep an object in view. When the object of interest changes position or if the point of interest changes, the visual system must shift the fovea to either maintain focus or move attention to a new target. The oculomotor system assists in the task of maintaining fovealization of a target through the use of a number of eye movement strategies. These eye movement strategies form the basis for steady vision and rely on inputs and integration of information from the vestibular system, proprioceptive system, and other senses to move the eyes appropriately.

The proprioceptive system is comprised of sensors that provide information about joint angle, muscle length, and muscle tension, which is integrated to give information that identifies where body parts are in space. The system is designed to give real-time feedback about the body's position in space and allow for appropriate actions to be taken when variables in the environment change. Skeletal muscle has two types of muscle responses, volitional and non-volitional. Volitional movements are voluntary movements of the body that are under conscious control and can be altered or planned by the individual. Non-volitional movements are involuntary movements that are reflexive within the body. Reflexive muscle groups are responsible for maintaining posture, adapting to perturbations experienced in the environment, and activating stabilizing musculature during volitional movements.

The vascular system of the body is designed to supply nutrients, oxygen, and other elements crucial for cellular survival throughout the body. When an increased workload is placed on a structure of the body, the vascular system will shunt blood to these areas to assist with the increased metabolic demand. As an example, when an individual uses a muscle, like performing a bicep curl, the vascular system will shunt blood to that muscle to provide additional support so the muscle can perform optimally. This helps the muscle to maximize its strength and adapt to added demand. The same mechanism is present with increased demand during activation of the central nervous system. When pathways within the nervous system are activated, more blood is shunted to those areas of activation to increase the nutrients and oxygen available for the neuronal cells.

The systems described above must work in concert with each other to facilitate optimal function of the nervous system. In order for a human subject to have accurate and appropriate perception and interaction with their environment, they must have proper central integration of information coming from the vestibular system, visual system, and proprioceptive system. During periods of movement and stimulation, proper blood flow must be administered to areas of activation of the nervous system as well as to the muscles of the body. When these systems do not work in concert, breakdowns in neurologic function occur. During processes in neurodegenerative diseases or traumatic brain injury there can be interruption of the typical pathways in the central nervous system that can cause inefficiencies in communication between areas of the brain and can distort the activation of the neuron and transport of nutrients and oxygen to parts of the brain that are in need of additional support. As these processes progress, there can be continued breakdown of neural pathways with continued aberrant firing in these neural networks. In order to address these breakdowns in neural communication, stimulations can be applied to neural pathways that are found to have aberrant firing. These stimuli can be applied through sensory receptors in the body including the vestibular system, the visual system, and the proprioceptive system. The 3-axis rotational device of the present invention provides a means of stimulating these pathways with a precision that has not been available in previous devices, due to its ability to rotate a human subject around three orthogonal axes independently from one another, simultaneously if desired.

When a disruption to the nervous system occurs, whether from trauma, vascular accident, neurodegenerative process, or developmental aberrancy, there can be a breakdown in central or peripheral nervous system pathways or in end organ sensors that create a deficit in how an individual perceives their world. When this occurs, the breakdown in these pathways can be quantified through physical examination and diagnostic testing. Once the location of the lesion has been identified, strategies can be implemented to stimulate and rehabilitate those pathways or the end organ receptors that are affected.

The 3-axis rotational device of the present invention allows for stimulation of multiple pathways that have peripheral and central consequences of stimulation. These stimulations can be tailored to address regions of the brain where aberrant neuronal relationships exist. By providing consistent stimulation in a controlled manner over time, these pathways can be adapted, retrained, and rehabilitated to function at their optimal potential.

Off vertical axis rotation (OVAR) of a human subject activates vestibulo-ocular responses (VOR). The VOR is served by stimulation of receptors in the inner ear that are associated with reflex movements of the eyes as well as the neck and trunk. The eye movements are a result of a combination of receptor activation in the inner ear (semicircular canal and otolith components). Some eye movements occur with semicircular canal activation in the planes of these canals while others occur in the plane of gravity by stimulating the otoliths.

OVAR is one of the few methods to evaluate and/or stimulate the function of otoliths. It has been used to quantify the maturation of the vestibular system and the processes of central compensation of the nervous system after vestibular injuries. OVAR is a useful method for clinically assessing both the otolith-ocular reflex and the semicircular canal-otolith interaction.

The positioning and rotational methods disclosed and claimed herein involve a computer-controlled chair that will rotate at a constant or variable velocity about an axis that is tilted with respect to the vector of gravity. The gravity vector can be considered to be 90 degrees to a level surface that is not tilted from a neutral position. As the chair moves, the head of a subject will be rotated about a tilted axis relative to the gravity vector, unless only the yaw axis is being rotated in an otherwise neutral (upright) position relative to gravity. The vestibular system has receptors that respond to gravitational forces. These receptors will be activated sinusoidally during rotation as the plane of the receptors changes with the change of the gravity vector.

The movement of a human subject can be measured specific to rotations and translations around 3 primary orthogonal axes. The Z-axis runs from the base of the feet up to the head of the human subject and rotations around this axis are referred to as yaw rotations. The Y-axis is an axis that is parallel to one that runs between the ears of the human subject and rotations around this axis are referred to as pitch rotations. The X-axis runs from the back of a human subject through the front and rotations around this axis are referred to as roll rotations. The computer-controlled chair can be rotated in an infinite combination of vectors around all possible axes of human movement.

For example, it is possible to combine rotations in one plane while simultaneously tilting the rotational axis in that plane or a combination of some or all other planes. This combination of OVAR results in eye movements in specific planes that are characterized with both slow and fast components specific to the axis stimulated. The slow component of eye movements has a mean velocity in the direction opposite to the head rotation and a sinusoidal modulation around the mean. Both the mean velocity and the modulation increase when the tilt angle and velocity of the chair movement occur.

OVAR in a combination of planes also results in changes of eye position in the orbit that compensate for head position changes when rotated. The mean slow velocity of eye movement is produced by a velocity storage mechanism in the vestibular system. The velocity storage system is well-studied and pathology in this system can be detected and treated by OVAR. The otolith organs induce compensatory eye position changes with regard to gravity for tilts in all planes (yaw, pitch and roll). These positional changes are observed to indicate central nervous system function and pathology.

OVAR in the three independent planes (X,Y,Z), which is enabled by the 3-axis device of the present invention, is the only mechanism to stimulate otolith organs in challenging gravitational postures. The 3-axis rotations will induce compensatory eye position changes with regard to gravity for tilts in the pitch, yaw and roll planes. Such compensatory changes can be utilized to examine and stimulate the function of the otolith organs. A functional interpretation of these results is that the combinations of fast and slow eye movements of the VOR will attempt to stabilize the image on the retina of one point of the surrounding world. Subjects that have difficulty in maintaining visual fixation on a target will benefit from this therapy and quantification of their function. Visual fixation on a steady target is necessary to stand and walk without falling. Falls are the largest cause of accidental death across all age groups and are a financial and emotional burden for society. The use of the 3-axis OVAR computer-assisted chair according to the present invention is specific to vestibular rehabilitation and fall prevention. Doses of stimulation and specificity of stimulation can be achieved in ways not previously achievable through use of previous OVAR devices.

The OVAR 3-axis chair of the present invention will allow physicians and therapists to change the representation of the gravity vector in a stereotaxic axis. In one embodiment, the chair is positioned such that the origin of the three axes X, Y and Z is located between the two labyrinths at the intersection of the frontal, sagittal and horizontal planes. The vector of gravity will be decomposed into its components along the 3 axes of the chair. During activation of the chair in a combination of axes, the gravity vector along the X- and Y-axis will vary sinusoidally while the gravity vector along the Z-axis will not vary in time. The gravity component that stimulates the brain is the sum of the gravity components along each axis.

When a human subject looks straight ahead, he/she will look along the X-axis which is the intersection of the sagittal and horizontal planes. The Y-axis is the axis that runs between the ears at the junction of the horizontal and frontal planes while the Z-axis is the intersection of the frontal and sagittal planes. The OVAR 3-axis chair of the present invention will allow the operator to activate the otolithic system while decomposing the gravity vector into three components (X,Y,Z) each along one stereotaxic axis. The axes of rotation while a human subject is experiencing rotation will be approximately, in one embodiment, around their center of mass. When a human subject is rotated in the chair, the excitation level of each cell in the maculae of the saccule and utricle is proportional to the scalar product of its polarization vector and linear acceleration.

The polarization vectors for the otoliths are located in the three planes (X,Y,Z), with the utricle responding to horizontal gravity vectors in yaw and roll and the saccule responding to pitch axis rotations. As the human subject is rotated around these axes there will be extremes of gravitational stimulation occurring in a sinusoidal fashion. When a human subject is inverted, there will be maximum gravity vectors with the head in the nose down position and also in the upright position. Rotation around the yaw axis is not associated with a sinusoidal gravitational stimulation. Rotating a human subject in the roll plane at a lateral tilt is a major activator of the otolithic system and there are no canals in the roll plane. The degree of lateral tilt will increase the gravity vector in roll proportional to the tilt. The 3-axis rotational chair of the present invention can excite the sensory cells of the maculae according to the orientation of the polarization vector. This will allow the brain to integrate rotational head velocity and eye position to activate neurons in the velocity storage pathway that is central to brain function.

The 3-axis rotational device of the present invention can use the vestibular system as an access point to the central nervous system by stimulating the semicircular canals and otolithic organs with specificity and accuracy that has not been obtained by prior art devices. Directions of rotation can be manipulated to isolate pairings of semicircular canals (i.e. rotation stimulating the right anterior canal and inhibiting the left posterior canal) or can be graded where combinations of canals are stimulated by altering the vector of rotation by a few degrees. This function is useful in treating patients who have a deficit in a semicircular canal pairing, however, are unable to handle direct stimulation of those canals due to the fragile state of their central pathways. In this case, rotations can be initially biased in the direction of healthy canals and the stimulation vector can be slowly changed to incorporate more of the sensitive canal system until it can be stimulated directly. The 3-axis device of the present invention is the first system to allow this type of modification and control to vestibular inputs and activation.

One embodiment of the present invention is a method for stimulating a vestibular system in a human subject comprising: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and stimulating at least one of an inner ear canal, a utricle or a saccule in the human subject by rotating the human subject independently around the pitch, roll and yaw axes. One example of a chair contained within the rotating frames is described above. In another embodiment, rotations caused by the rotating step are initially biased towards a healthy canal and then changed to increasingly incorporate a sensitive canal. It is understood that "rotating the human subject independently around the pitch, roll and yaw axes" does not require that all three axes of rotation be used simultaneously. For example, the human subject may first be rotated around the yaw axis a predetermined number of degrees and then the yaw rotation halted, after which the roll and pitch frames are actuated to rotate the human subject along a predetermined vector path. Other combinations of rotations are also included, of course. This is the case for all of the treatment methods described and claimed herein that involve rotation of a human subject around the three independent axes.

A similar treatment mechanism is present with activation of the central nervous system utilizing the visual system. As a human subject moves through their environment, the visual system uses a number of strategies to manage visual input and keep an object of interest steady on the fovea or focus attention to a new object of interest. These strategies include gaze holding, pursuit eye movements, saccadic eye movements, and optokinetic nystagmus. Gaze holding holds the eyes stationary when they are fixating on a target in the field of vision. Pursuit eye movements hold steady gaze on a target that is moving or when a human subject is moving in relationship to the target of interest. Saccadic eye movements are fast eye movements that refixate gaze on a new target of interest and optokinetic nystagmus is a combination of slow and fast eye movements that responds to shifts of the visual scene. Each of these eye movements is associated with specific regions and pathways in the brain. When there are aberrancies in the neuronal communications to these regions and along these pathways, significant deficits occur in the human subject's perception of the world and their ability to interact with their environment. The 3-axis chair of the present invention can be utilized to rehabilitate these eye movement deficits. By identifying the eye movements that are faulty and the location in the visual field where deficits are present, rotational strategies can be administered that very specifically address the problem areas. Prior art designs only gave the ability to address these concerns when they occur in certain planes, however, the 3-axis chair design of the present invention allows for rehabilitation strategies to be applied through any plane of eye movement where there is a deficit.

One embodiment of the present invention is a method for stimulating a visual system in a human subject comprising: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and rotating the human subject independently around the pitch, roll and yaw axes while the human subject is fixating on a visual target of interest. In another embodiment, the visual target of interest is moving. In still another embodiment, the visual target of interest is stationary.

The proprioceptive system feeds information from the body back to the brain about the orientation of the muscles and joints in space. During a developmental aberrancy, neurodegenerative process or after a traumatic injury either to the brain or to the body, irregular signaling can occur through this system that creates motor deficits and postural abnormalities within the body. This can manifest as muscle hypertonicity, muscle hypotonicity, or postural distortions. These aberrant muscle firing patterns or postural distortions can be quantified through examination and regions of the brain or body of the human subject where deficits exist can be identified. Through the use of independent 3-axis rotation, as disclosed herein, strategies can be implemented that activate muscles that have become hypotonic, inhibit musculature that is hypertonic, or address postural deficits or abnormalities. The 3-axis rotational device of the present invention provides a means to administer this type of stimulation in combinations that are unique and appropriate for the proprioceptive deficiency that exists.

One embodiment of the present invention is a method for stimulating a proprioceptive system in a human subject comprising: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and stimulating the proprioceptive system in the human subject by rotating the human subject independently around the pitch, roll and yaw axes.

The vascular blood supply to the brain is another system that will benefit from the ability to rotate a human subject in 3 independent axes of rotation. When an area of the human subject's body or brain becomes active, the nervous system will increase the blood flow to the tissues that facilitate that activity. If this activity continues over time, the vascular system will increase the quantum of vasculature in that region and provide more oxygen and nutrients to the cells. Within the central nervous system, the blood supply to the brain facilitates proper communication and maintenance of neuronal pathways. Neurodegenerative conditions and traumatic brain injury can have the opposite effect on blood supply to a region of the brain. Decreased blood flow and perfusion into pathways of the nervous system can have detrimental effects on the neurons in those networks. As a human subject is rotated in the 3-axis rotational chair of the present invention, centrifugal forces will assist in driving blood flow to the brain. In order to increase blood flow to damaged or degraded regions of the brain and nervous system, consistent and appropriate stimulation must be applied to the affected pathways over time to increase activation of neurons and ultimately blood perfusion to those tissues.

One embodiment of the present invention is a method for stimulating a vascular system in a human subject's brain comprising: securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; and perfusing blood into a region of the brain by rotating the human subject independently around the pitch, roll and yaw axes.

The 3-axis rotational device disclosed herein is a therapeutic intervention that can accomplish this through the various receptors described previously. Having the ability drive therapies through one or various combinations of the vestibular system, the visual system, the proprioceptive system, and inducing blood flow with 3-axis rotation that is specific to the deficits that are present in those systems allows clinicians to provide treatments tailored in ways not available through previous designs.

Human subjects diagnosed or suspected of having neurological conditions often have dysfunction in different facets of neural processing. Some individuals have inaccuracies in the ability to detect and/or transfer sensory signals to be sent to central processors. Others may have difficulty in their ability to receive these signals and process them in an accurate, timely manner. Still others may have errors in converting sensory stimuli into central integration to be executed as accurate or appropriate movement, cognition, emotion or effect by the individual. Oftentimes people with neurological dysfunction have combinations of these processing errors that culminate in the conventional diagnostic criteria that are commonplace in the practice of health care.

Utilization of 3-axis rotation can be beneficial for those suffering with these types of disorders as the stimulation dosage and type may be manipulated to adapt or modify these errors in neural processing to improve the functionality of the system. Implementing this type of stimulation can be used to drive positive neuroplastic changes within the central nervous system.

Disorders that may benefit from this intervention include, but are not limited to the following classifications, based on the current nomenclature and diagnostic criteria:

Balance disorders are a common manifestation of vestibular, visual, and proprioceptive deficit. Stimulation of these systems can be utilized to rehabilitate numerous conditions that affect peripheral as well as central manifestations of these disorders in human subjects. Positive neuroplastic changes can be made through the use of 3-axis rotation in these cases. Some of these cases include: Dysequilibrium, Mal De Débarquement, Motion-sickness, Presyncope, and Vertigo.

Deficiencies of gaze and eye movements are very common signs of dysfunction in a number of pathological- and trauma-oriented conditions. Stimulation of the vestibular and oculomotor pathways can aid greatly in addressing the central issue causing the ocular dysfunction in a human subject. 3-axis rotation, as described herein, allows for therapies to be implemented that can specifically address the plane of aberrancy in which these dysfunctions occur. This is accomplished by rotating the individual through directions that will stimulate central visual and central vestibular pathways that correlate to the eye movements where pathology is present. Some of these conditions include: Convergence Insufficiency, Convergence Spasm, Diplopia, and Dysjunctive Eye Movements.

Developmental delay is a condition that affects millions of children in the United States and around the world. As the human body is early in development, it uses stimuli from its environment to mold and form its perception and understanding of the world around it. When a child misses establishment of specific connections in the brain, significant delays or deficits can arise that will hinder the child from engaging in an appropriate or typical way. Senses and systems like the vestibular system, the visual and oculomotor system, and the proprioceptive system can be used as access points to the central nervous system to provide increased stimulation to areas of the brain that are experiencing aberrant development or delay. This added stimulation can help increase integration of areas of the brain connected to these systems and drive developmental processes toward a more typical development pathway. Some of these conditions include: Alexia, Attention Deficit Hyperactivity Disorder (ADD/ADHD), Autism Spectrum Disorders, Dyslexia, Obsessive Compulsive Disorder (OCD), Oppositional Defiant Disorder (ODD), Pervasive Developmental Disorder (PDD)/Not Otherwise Specified (NOS), and Social Communication Disorder (SCD).

Dysautonomia is a condition where there is dysregulation of the cardiovascular system. This may manifest as irregularities, acceleration, or deceleration of the heartbeat, abnormal blood flow and perfusion to tissues in the body (peripheral and central), and hypersensitivity to touch. The cardiovascular system is regulated by central nervous system connections in the brain and brainstem. These regions have crossover connections with regions that integrate with the vestibular and proprioceptive system. By this mechanism, 3-axis rotation can make an impact therapeutically with this population of individuals. Some conditions that can be affected through this approach include: Cardiac Arrhythmia, Reflex Sympathetic Dystrophy, Reynaud's Phenomenon, and Tachycardia.

Movement disorders are highly prevalent conditions of human subjects associated with neurological conditions that affect the speed, fluency, quality, and ease of movement. Abnormal fluency or speed of movement may involve excessive or involuntary movement (hyperkinesia) or slowed or absent voluntary movement (hypokinesia). These conditions affect the function of; and are consequences of aberrancies in the visual, oculomotor, vestibular and somatosensory systems of humankind. 3-axis rotation can be used to drive positive neuroplastic changes that can address these types of issues. Movement disorders include, but are not limited to: Abulia/dysbulia, Akinetic/Rigid Syndromes, Aphasia/dysphasia, Apraxia/dyspraxia, Ataxia/dystaxia, Bradykinetic Syndromes, Dyskinesias, Dystonias, Myoclonus, Spasticity, Stereotypic Movement Disorder, Tic/Tourette's Syndrome, and Tremor.

Neurodegenerative disorders include a range of conditions that cause damage largely within the neurons of the brain and spinal cord. Degeneration of these neurons can result in the inability of different regions of the brain of a human subject to operate and furthermore to communicate with other regions and pathways of the brain. The effects are far-reaching and though the function of one area of the brain may not be directly related to another area, damage in the shared communication networks can provide a mechanism for massive functional loss. While neurodegenerative conditions cause damage to neurons that may be irreplaceable, surviving neurons may provide alternative communication pathways through creation of new connections to other neuronal networks (synaptogenesis). 3-axis rotation is a powerful means to drive this connectivity. Some neurodegenerative disorders that can be treated by 3-axis rotation include: Alzheimer's Disease, Coritcobulbar Degeneration, Dementia, Multiple Sclerosis, Multiple System Atrophy, Parkinson's Disease/Parkinson-Plus/Atypical Parkinson's, and Supranuclear Palsy.

Orthostatic intolerance is a condition where specific positions of the human body cause excessive increases, decreases, or fluctuations in blood pressure or heart rate. As a human subject moves from a lying position or seated position to a standing position, the brain will sense a drop in blood pressure through baroreceptors or a change in position through the otolithic system and make compensatory changes to keep blood perfusion to the entire body as constant and consistent as possible. In a human subject who has sustained a bodily injury which affects this system, it can cause extreme shifts of blood pressure or heart rate. One mechanism to rehabilitate this system is the use of vestibular input through the otolithic system to recalibrate the system so that changes of position do not elicit an aberrant response from the body. The 3-axis rotational device is a means of providing this stimulation in a manner that is specific to the injury that has occurred. Some of these conditions include: Orthostatic Hypotension and Positional Orthostatic Tachycardic Syndrome (POTS).

Pain syndromes include those conditions associated with abnormal perception of nociception, leading to suffering in a human subject. Pain is a complex phenomenon that has a multitude of origins. Pain as a central consequence is problematic for human subjects as well as healthcare providers in the sense that the pain generator is due to a faulty perception of sensory stimuli. This perception occurs as an inaccuracy in central processing within the brain. These central processing systems have shared neural networks with the systems that are influenced by the stimulation associated with multiple axis rotation. In this sense, 3-axis rotation can be used in a therapeutic approach to decrease the impact of these types of conditions. Pain syndromes include, but are not limited to: Cervicalgia, Cluster Headache, Complex Regional Pain Syndrome (CRPS), Headache, Lumbalgia, Migraine, Temperomandibular Joint Disorder, Thoracalgia, and Trigeminal Neuralgia.

Traumatic brain injury is a condition that can have profound impact on the nervous system and sensing organs of a human subject. Traumatic injury can occur to in any region of the brain. The systems affected can be wide-ranging or focal in their distribution or presentation. When these deficits are quantified, a determination of the regions of the brain affected can be made. If the injury affects the vestibular system, visual system, oculomotor system, somatosensory system, the vascular system, or any system in communication with these systems, a therapy regimen utilizing 3-axis rotation may be used to rehabilitate the damaged areas of the brain. Some of these conditions include: Centrally-maintained Vestibulopathy, Mild/Moderate/Severe Traumatic Brain Injury, Post-concussive Syndrome and Stroke.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

What is claimed is:

1. A method for stimulating a visual system in a human subject comprising:

securing the human subject to a chair, wherein the chair is contained within: a pitch frame that rotates the chair about a pitch axis, a yaw frame that rotates the chair about a yaw axis, and a roll frame that rotates the chair about a roll axis; wherein the pitch, roll and yaw axes are orthogonal to each other, and comprise an origin located within the human subject; wherein the yaw frame is contained within the roll frame such that when the roll frame is rotated around the roll axis, the yaw frame will also be rotated about the roll axis; and rotating the human subject along a vector path by actuating combinations of the pitch frame, roll frame and yaw frame independently around the pitch, roll and yaw axes, without any limitation on degree of rotation, while the human subject is fixating on a visual target; and during the rotating step:

providing the visual target for the subject to coordinate eye movements with the rotating;

identifying a faulty eye movement chosen from the group consisting of gaze holding, pursuit eye movements, saccadic eye movements, and optokinetic nystagmus; and rehabilitating the faulty eye movement by applying rotation through any plane where there is a deficit.

* * * * *